US009840973B2

(12) United States Patent
Wagner et al.

(10) Patent No.: US 9,840,973 B2
(45) Date of Patent: Dec. 12, 2017

(54) METHOD AND DEVICE FOR CARRYING OUT AN ADAPTIVE CONTROL OF A POSITION OF AN ACTUATOR OF A POSITION TRANSDUCER

(71) Applicant: Robert Bosch GmbH, Stuttgart (DE)

(72) Inventors: Alexandre Wagner, Stuttgart (DE); Ralf Buehrle, Hochberg (DE)

(73) Assignee: Robert Bosch GmbH, Stuttgart (DE)

( * ) Notice: Subject to any disclaimer, the term of this patent is extended or adjusted under 35 U.S.C. 154(b) by 1142 days.

(21) Appl. No.: 13/908,632

(22) Filed: Jun. 3, 2013

(65) Prior Publication Data

US 2013/0325294 A1 Dec. 5, 2013

(30) Foreign Application Priority Data

Jun. 4, 2012 (DE) ..... 10 2012 209 384

(51) Int. Cl.
*F02D 41/00* (2006.01)
*F02D 41/14* (2006.01)
(Continued)

(52) U.S. Cl.
CPC ..... *F02D 41/0002* (2013.01); *F02D 11/106* (2013.01); *F02D 41/1401* (2013.01);
(Continued)

(58) Field of Classification Search
CPC ..... F02D 41/0002; F02D 41/1401; F02D 41/2474; F02D 11/106; F02D 2041/141; F02D 2041/1423; F02D 2041/1409
See application file for complete search history.

(56) References Cited

U.S. PATENT DOCUMENTS 4,622,936 A * 11/1986 Junginger ..... B60K 26/04 123/361
4,827,937 A * 5/1989 Kohler ..... F02D 41/2454 123/406.33
(Continued)

FOREIGN PATENT DOCUMENTS

CN 2221796 Y 3/1996
CN 1275216 A 11/2000
(Continued)

*Primary Examiner* — Hieu T Vo
*Assistant Examiner* — Arnold Castro
(74) *Attorney, Agent, or Firm* — Norton Rose Fulbright US LLP; Gerard Messina

(57) ABSTRACT

A method for operating a controller for a position transducer system, of a throttle valve position transducer in an engine system having an internal combustion engine, the control being performed to obtain a manipulated variable for triggering an actuating drive of the position transducer system, the control being performed by initially applying a transfer function to a system deviation to obtain an adapted system deviation and subsequently applying a transfer function to the adapted system deviation to obtain the manipulated variable, the transfer function being a function which indicates a deviation of a model of a nominal position transducer system having predefined nominal parameters from the model of the position transducer system to be controlled, an adaptation of the control process being performed by adapting the transfer function, in that the parameters of the model of the position transducer system to be controlled are adapted, in particular in real time.

19 Claims, 8 Drawing Sheets

(51) Int. Cl.
*F02D 41/24* (2006.01)
*F02D 11/10* (2006.01)

(52) U.S. Cl.
CPC .... *F02D 41/2474* (2013.01); *F02D 2041/141* (2013.01); *F02D 2041/1409* (2013.01); *F02D 2041/1423* (2013.01)

(56) References Cited

U.S. PATENT DOCUMENTS 4,849,896 A * 7/1989 Burk ..... F16H 59/20 123/337
5,033,431 A * 7/1991 Poirier ..... F02D 11/10 123/339.24
5,333,109 A * 7/1994 Oo ..... B60K 31/047 123/350
6,484,693 B1 * 11/2002 Kanno ..... F02B 61/045 123/339.15
6,502,545 B1 * 1/2003 Ganser ..... F02D 11/105 123/348
6,636,783 B2 * 10/2003 Yasui ..... F02D 35/0007 123/399
6,668,214 B2 12/2003 Yasui et al.
6,830,032 B2 * 12/2004 Yasui ..... F02D 35/0007 123/349
7,463,936 B2 * 12/2008 Baumann ..... F02D 11/105 123/339.14
7,533,654 B1 * 5/2009 Zurawski ..... F02D 11/105 123/376
7,905,213 B2 * 3/2011 Fokkelman ..... F02D 11/10 123/361
2003/0047148 A1 * 3/2003 Unger ..... F02D 35/028 123/27 R
2004/0123850 A1 * 7/2004 Baeuerle ..... F02D 23/00 123/564
2004/0231641 A1 * 11/2004 Wind ..... F02D 11/106 123/396
2005/0046375 A1 * 3/2005 Maslov ..... B60L 8/00 318/650
2006/0201487 A1 * 9/2006 Mallebrein ..... F02D 19/12 123/478
2008/0120017 A1 * 5/2008 Rodatz ..... F02D 41/1401 701/108
2009/0138183 A1 * 5/2009 Fokkelman ..... F02D 11/10 701/110
2010/0256891 A1 * 10/2010 Weiss ..... F02D 35/023 701/103
2011/0010072 A1 * 1/2011 Burkhardt ..... F02D 23/00 701/102
2013/0269319 A1 * 10/2013 Rodatz ..... F01N 11/007 60/274
2013/0325294 A1 * 12/2013 Wagner ..... F02D 41/2474 701/103

FOREIGN PATENT DOCUMENTS

CN 1828458 A 9/2006
CN 101384808 A 3/2009
EP 378093 A2 7/1990
EP 660017 A1 6/1995
RO 113624 B1 9/1998
WO 2007/096327 8/2007

* cited by examiner

METHOD AND DEVICE FOR CARRYING OUT AN ADAPTIVE CONTROL OF A POSITION OF AN ACTUATOR OF A POSITION TRANSDUCER

RELATED APPLICATION INFORMATION

The present application claims priority to and the benefit of German patent application no. 10 2012 209 384.2, which was filed in Germany on Jun. 4, 2012, the disclosure of which is incorporated herein by reference.

FIELD OF THE INVENTION

The present invention relates to control methods for position transducers, in particular adaptive control methods for position control of a position transducer.

BACKGROUND INFORMATION

The position of actuators in position transducer systems in an internal combustion engine is generally ascertained with the aid of a control method as a function of one or more internally or externally predefined setpoint variables. However, manufacturing tolerances as well as environmental influences and aging result in the response of the actuator and of the position transducer system deviating from the expected response or if there are changes in same. The position transducer system to be controlled thus changes as a function of its operating conditions.

In general, a control method should achieve a compromise between all possible states of the actuator, so that the control system achieves a good response with respect to bandwidth, stability, precision and robustness in all operating states. However, adapting the control method and its control parameters to a position transducer having certain properties results in an undesirable system response when the tolerances and the environmental effects on and aging of the actuator become too great and therefore the properties of the position transducer differ too much from those of a position transducer to which the control method and its control parameters are adapted. It is therefore necessary to adapt the control accordingly to achieve an optimal system response over the entire lifetime of the position transducer.

Publication WO 2007/096327 A1 discusses an adaptive control method for a throttle valve in which a pilot control is adapted as a function of measured operating conditions, for example, temperature, air mass flow and pressure drop across a throttle valve.

Publication U.S. Pat. No. 6,668,214 discusses an adaptive control method having online parameter identification. The identified parameters are used to compensate for dead time in the control loop and to adapt a sliding mode controller.

SUMMARY OF THE INVENTION

According to the present invention, a method for operating a controller of a position transducer system, in particular a throttle valve position transducer in an engine system having an internal combustion engine according to the description herein is provided, and a control device and a computer program product according to the other descriptions herein are also provided.

Additional advantageous embodiments of the present invention are stated in the further descriptions herein.

According to a first aspect, a method for operating a controller for a position transducer system is provided, the control being carried out to obtain a manipulated variable for triggering an actuating drive of the position transducer system, the control being carried out by initially applying a transfer function to a system deviation to obtain an adapted system deviation and subsequently a transfer function is applied to the adapted system deviation to obtain the manipulated variable, the transfer function being a function which indicates a deviation of a model of a nominal position transducer system having predefined nominal parameters from the model of the position transducer system to be controlled, an adaptation of the control process being carried out by adapting the transfer function in that the parameters of the model of the position transducer system to be controlled are adapted.

One aspect of the above method is to configure the controller of the position transducer system in such a way that an adaptation is carried out in that a system deviation is adapted before a transfer function is applied. For this purpose, the transfer function is adapted to a transfer function for adaptation of the system deviation so that the adapted system deviation takes into account only the deviation of the response of the physical position transducer system from a reference position transducer system or a nominal position transducer system, while the transfer function is configured for the reference position transducer system or the nominal position transducer system in accordance with the control process. The control parameters used there may be disregarded in an adaptation of the control process. This has the advantage that an adaptation of the control process may be carried out rapidly and without intervention into the control process in that merely the transfer function using the model parameters of the position transducer system, which change due to the change in the physical response of the position transducer system, may be adapted.

In addition, the transfer function may be a control function having constant predefined control parameters, which have been ascertained with respect to a nominal position transducer system and are invariant for the adaptation of the control process.

In particular it may be provided that only linear components are taken into account as the model of the nominal position transducer system and as the model of the position transducer system to be controlled.

According to one specific embodiment, the transfer function may also take into account a pilot control variable which is ascertained as a function of an inverse model of the position transducer system to be controlled and of the model parameters which are ascertained and adapted online.

In addition, a nonlinear component of the model of the position transducer system to be controlled may be taken into account in the pilot control to compensate for nonlinearities in the position transducer system.

It may be provided that the transfer function is implemented as a discrete recursive equation with the aid of Tustin's method.

According to another aspect a control system for operating a controller for a position transducer system is provided, the control being carried out to obtain a manipulated variable for triggering an actuating drive of the position transducer system, including an adaptive filter to apply a transfer function to a system deviation in order to obtain an adapted system deviation, the transfer function representing a function which indicates a deviation of a provided model for a nominal position transducer system using predefined nominal parameters from a provided model of the position transducer system to be controlled, a control block to apply a transfer function to the adapted system deviation to obtain the manipulated variable, the adaptive filter being configured to adapt the model of the position transducer system to be controlled in accordance with providable model parameters.

According to another aspect, a computer program having program code means is provided to carry out all steps of the above method when the computer program is executed on a computer or an appropriate arithmetic unit, in particular in the above control system.

According to another aspect, a computer program product is provided, containing program code which is stored on a computer-readable data medium and carries out the above method when executed on a data processing system.

Specific embodiments of the present invention are explained in greater detail below on the basis of the accompanying drawings.

DETAILED DESCRIPTION

Figure 1:
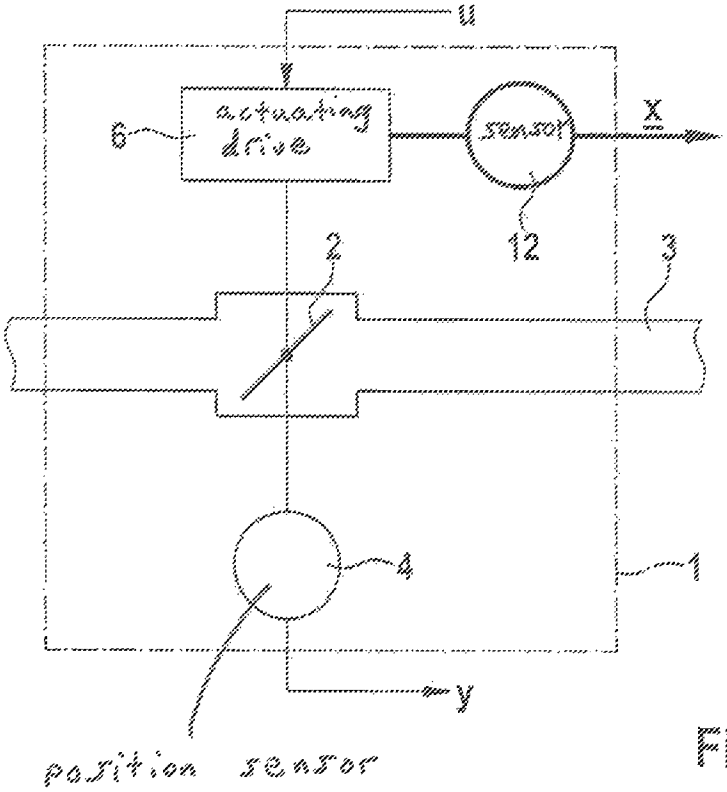
FIG. 1 shows a schematic diagram of a position transducer system using the example of a throttle valve position transducer.

FIG. 1 shows a schematic diagram of a position transducer system 1 using the example of a throttle valve position transducer system. Position transducer system 1 has a throttle valve situated in a gas carrying line 3 as actuator 2. The actuator is movable and may be adapted to provide an adaptable flow resistance in gas carrying line 3. In other words, the quantity of a gas flowing through gas carrying line 3 may be determined by the position of actuator 2.

Actuator 2 is connected to an actuating drive 6, which may be configured as an electromechanical actuating drive, for example. Actuating drive 6 may be triggered by electrical triggering signals to exert an actuating torque or an actuating force on actuator 2, so that the latter is moved. Actuating drive 6 may be configured as a dc motor, as an electrically commutated motor or as a stepping motor, for example, each of which may be triggered by suitable pulse width-modulated trigger signals. Actuating drive 6 is able to provide the actuating torque via the trigger signals, which may be generated by a driver circuit using one or more H bridge circuits.

The actual position of actuator 2 may be detected by a position sensor 4 connected to actuator 2 and may be provided as actual position indication y. Additional state variables of position transducer system 1, such as a motor current, which is picked up for providing an actuating torque by actuating drive 6 and the like, may be detected with the aid of an additional sensor 12 connected to actuating drive 6.

Position transducer system 1 is generally exposed to environmental influences and aging in the area of application. Furthermore, the individual components are subject to tolerances during their manufacture. This may result in the system response of position transducer system 1 possibly deviating from a desired nominal system response. Since a controller for position transducer system 1 must usually be adapted to the nominal system response of a position transducer, this may result in maladjustments, which has a negative effect on the quality of the control process.

Figure 2:
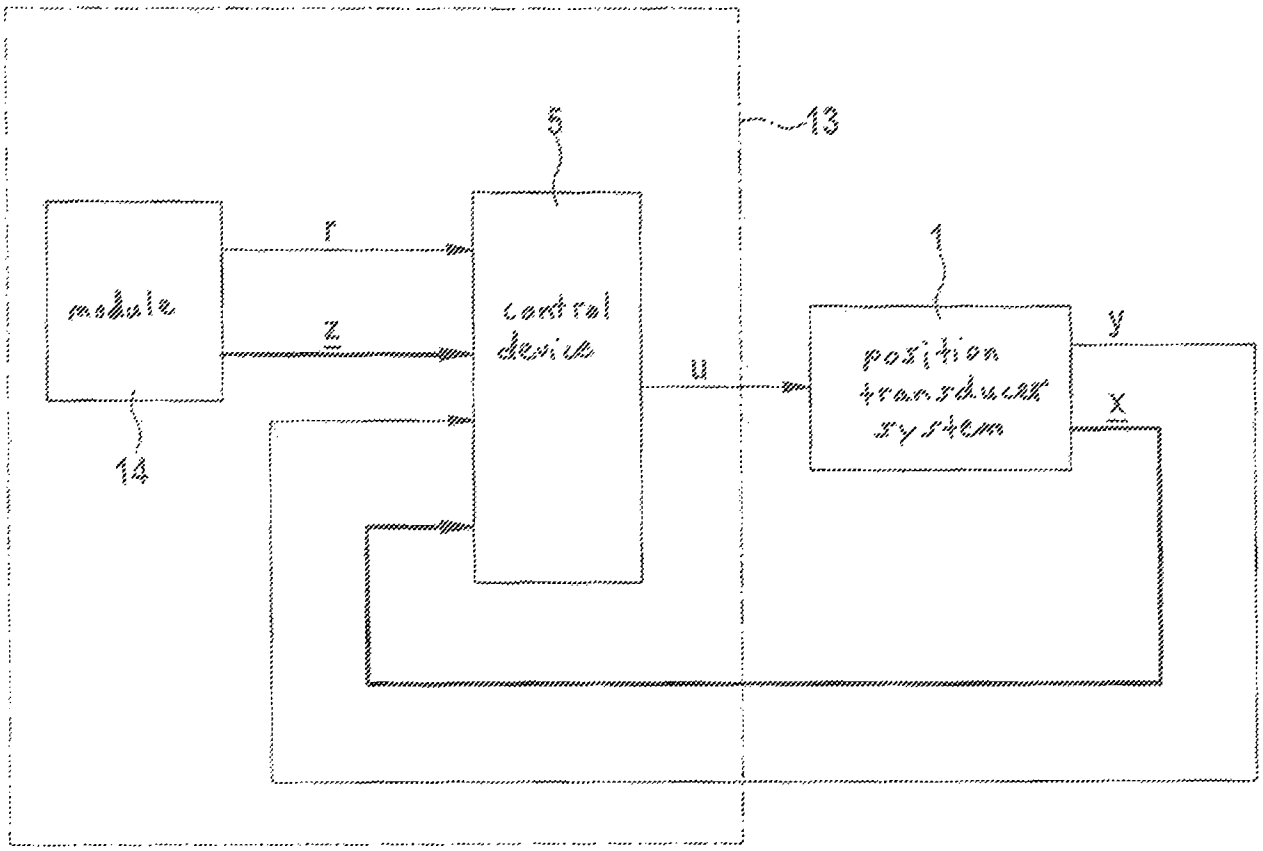
FIG. 2 shows a function diagram to illustrate a position control for the position transducer of FIG. 1.

FIG. 2 schematically shows essentially a control system 13 for controlling actuating drive 6 of position transducer system 1. A control device 5 is provided, which receives actual position indication y from position sensor 4 and also includes a module 14, which provides a setpoint position indication r and additional measured or modeled state variables z to control device 5. For example, one of the provided state variables z may correspond to battery voltage $U_{bat}$.

In addition, control device 5 receives measured variables x such as the motor current or the like from position transducer system 1, for example. Control device 5 generates a manipulated variable u from the obtained information and uses it to trigger actuating drive 6 of position transducer system 1. Manipulated variable u may be, for example, a pulse duty factor for a pulse width-modulated triggering of a driver circuit for actuating drive 6, which corresponds to the effective level of the voltage applied to actuating drive 6. The pulse duty factor is able to determine the ratio of a period of time during which a motor current flows through actuating drive 6 to a cycle duration, the cycle duration corresponding to a period of cyclic triggering of actuating drive 6.

Figure 3:
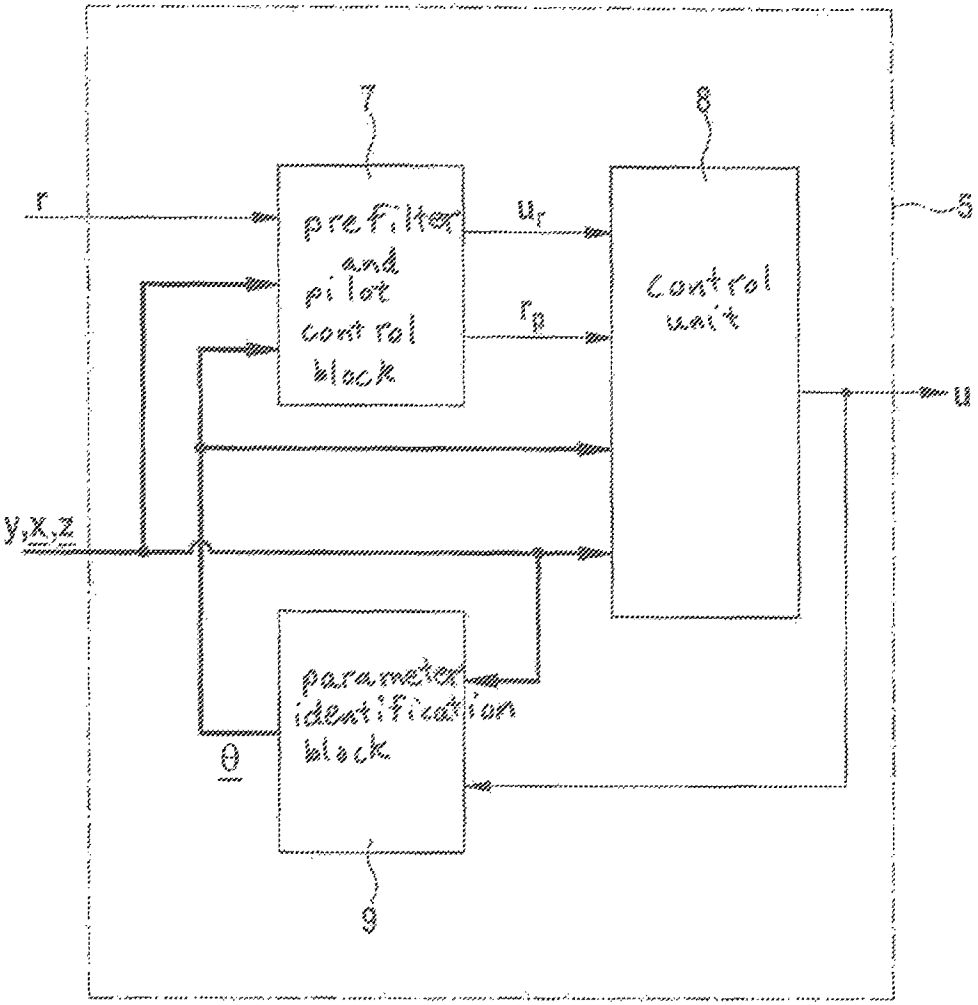
FIG. 3 shows a function diagram to illustrate the creation of the manipulated variable for the position control of FIG. 2.

FIG. 3 shows the structure of control device 5 in detail. Control device 5 includes a prefilter and pilot control block 7, a parameter identification block 9 and a control unit 8. Parameter identification block 9 calculates regularly, cyclically or at a predefined point in time model parameters Θ of a computation model of position transducer system 1, i.e., the model parameters of the computation model of position transducer system 1 may be determined during active control. Model parameters Θ of the computation model of position transducer system 1 are ascertained on the basis of manipulated variable u, actual position indication y of actuator 2 and optionally on the basis of states x and z, which are additionally measured and modeled, such as motor current and/or battery voltage $U_{bat}$ and the like, for example. Parameter identification block 9 is able to ascertain model parameters Θ, for example, by using a recursive method (a recursive least square method or a gradient method).

Filtering of setpoint position indication r into a filtered setpoint position indication $r_p$ and generating a pilot control variable $u_r$ for manipulated variable u are carried out in prefilter and pilot control block 7. For this purpose, instantaneous determined parameters Θ of a computation model of position transducer system 1 as well as a few additional measured and modeled states x and z and instantaneous actual position indication y of actuator 2 are needed.

Manipulated variable u for actuating drive 6 is generated in control unit 8 with the aid of pilot control variable $u_r$, filtered setpoint position $r_p$, instantaneous actual position indication y of actuator 2, repeatedly determined model parameters Θ of a computation model G of position transducer system 1 and optionally a few additional measured and modeled state variables z of the system as a whole and one or more state variables x of position transducer system 1.

Figure 4:
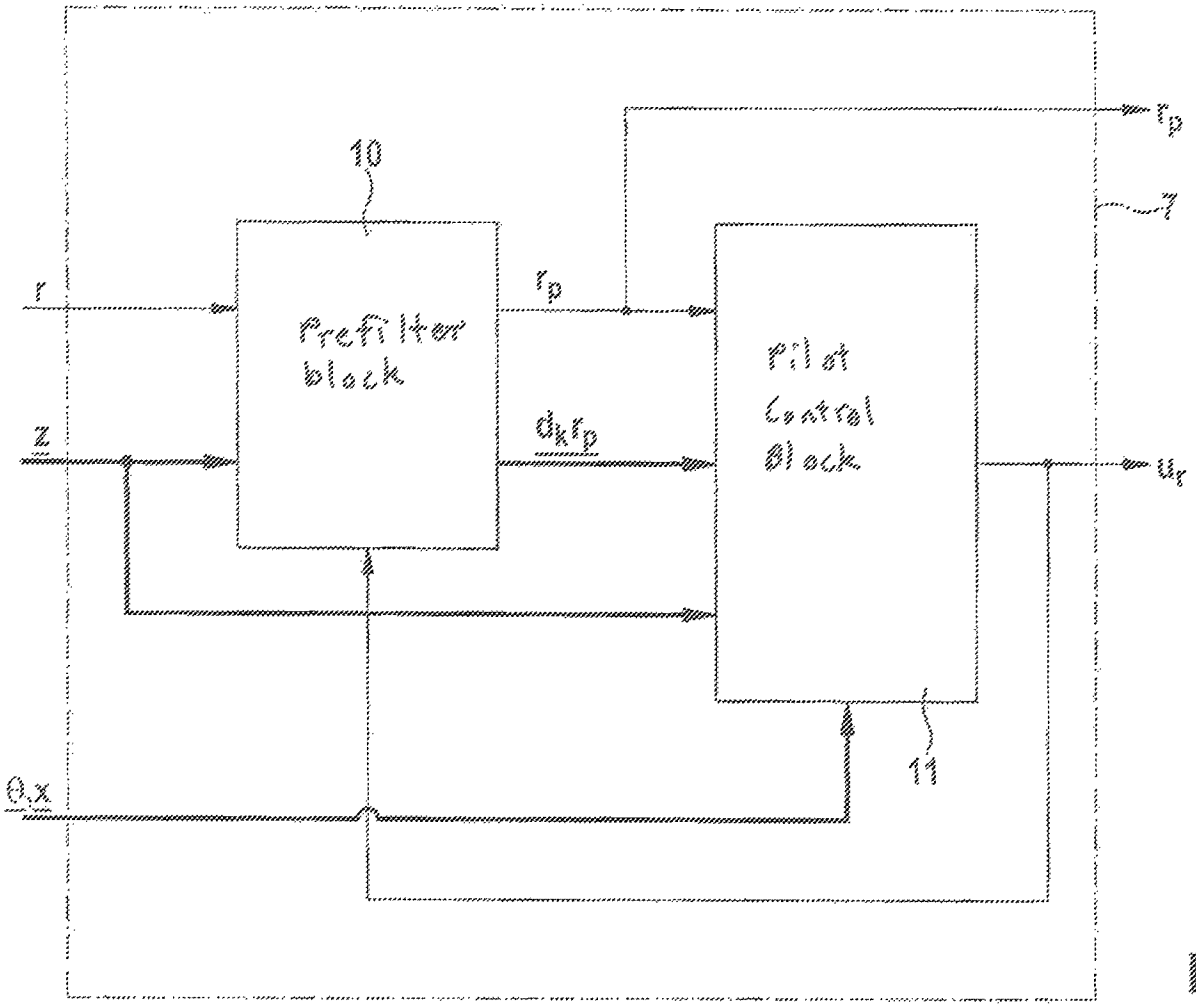
FIG. 4 shows a function diagram to illustrate a prefilter and a pilot control for generating the manipulated variable of the position control of FIG. 2.

FIG. 4 shows in detail the structure of prefilter and pilot control block 7. Prefilter and pilot control block 7 has a prefilter block 10 and a pilot control block 11. Prefilter block 10 acts as a state-variable filter. The order of prefilter 10 corresponds to the order n of the system. A prefilter of the third order (n=3) is selected in this exemplary embodiment. The order of prefilter 10 may differ from this in other exemplary embodiments.

Prefilter block 10 is implemented in such a way that it low-pass filters the setpoint position indication r to provide filtered setpoint position indication $r_p$ and to provide a vector $d_k r_p$ having k of 1 to n in the case of filtered setpoint position indication $r_p$. Vector $d_k r_p$ is a vector of the derivations from $r_p$ to the order n. For n=3, vector $d_k r_p$ is composed of $d_1 r_p$ as the first derivation from $r_p$ over time, $d_2 r_p$ as the second derivation from $r_p$ over time and $d_3 r_p$ as the third derivation from $r_p$ over time. Prefilter block 10 uses pilot control variable $u_r$ and a few other measured and modeled state variables z of the system as a whole such as, for example, battery voltage $U_{bat}$ and other variables to calculate its output variable anew, when pilot control variable $u_r$ reaches its voltage limit, which is a function of the additionally measured and modeled state variables z. Prefilter block 10 implements primarily the low-pass function, which is necessary to permit usable derivations since setpoint position indication $r_p$ may contain noise.

Pilot control block 11 is configured as a flatness-based pilot control block. Pilot control block 11 carries out a calculation of an inverse function $G^{-1}$ of computation model G of position transducer system 1 with the aid of instantaneously determined model parameters Θ and derivations $d_k r_p$ of filtered setpoint position indication $r_p$. Pilot control block 11 may also take into account the additionally measured and modeled state variables x and z to carry out an adaptation.

Figure 5:
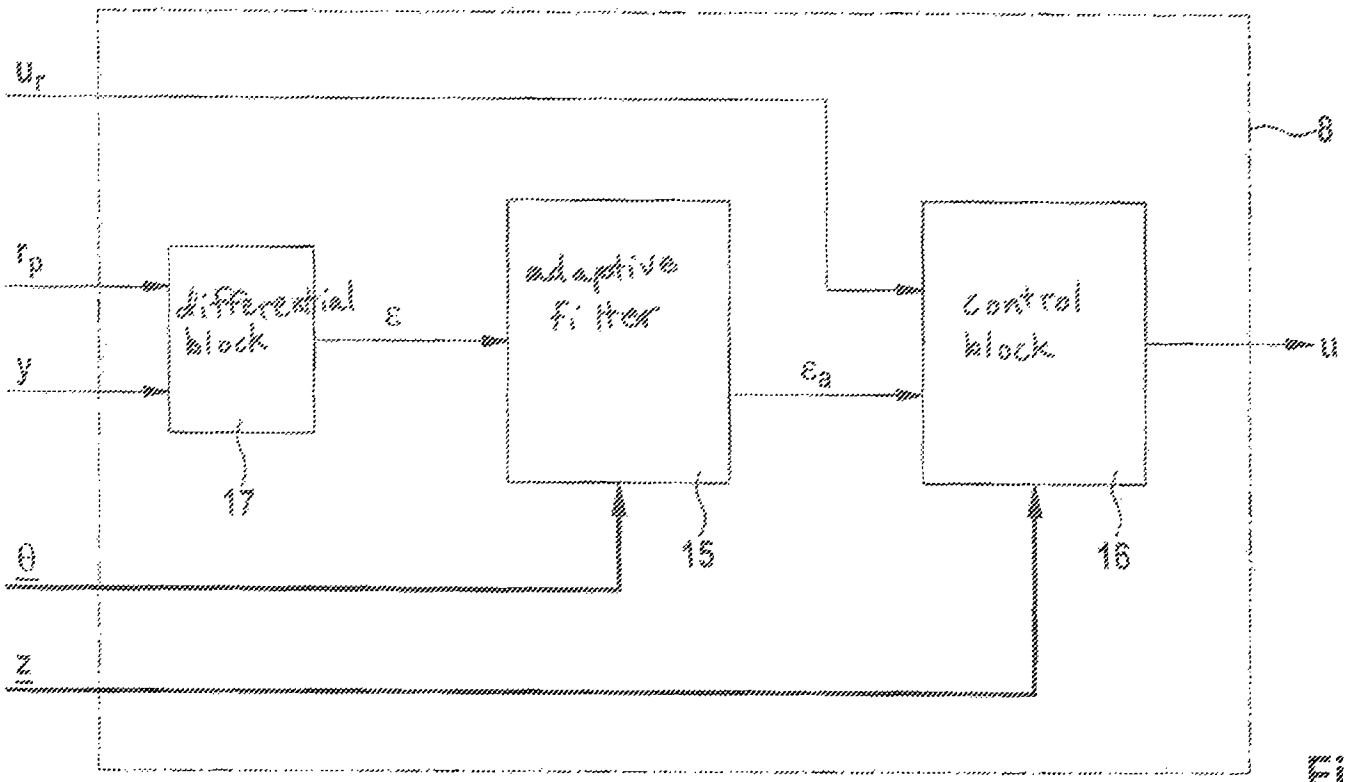
FIG. 5 shows a function diagram to illustrate the control unit for generating the manipulated variable.

FIG. 5 shows the structure of control unit 8. Control unit 8 includes a differential block 17, an adaptive filter 15 and a control block 16. Differential block 17 ascertains the system deviation as a difference E between filtered setpoint position indication $r_p$ and instantaneous actual position indication y of actuator 2: $\epsilon = r_p - y$.

Adaptive filter 15 carries out an adaptation of system deviation E to adapted system deviation $\epsilon_a$ in such a way that control block 16 always controls a similar system. Linear computation model G of actuator 2 may correspond to a transfer function H of the order n, which is characterized by instantaneously determined model parameters Θ.

Control block 16 corresponds to a transfer function C, which may be implemented as a discrete recursive equation with the aid of Tustin's method for discretization. Depending on the type of control, at least one of control parameters $K_p$, $K_i$, $K_d$ may be implemented for the proportional component, the integration component and the differential component, which are provided as constant nonadaptable control parameters. Fundamentally any type of control is conceivable here.

As an alternative, it may be provided that control block 16 is configured using variable control parameters instead of fixed control parameters $K_p$, $K_i$, $K_d$, so that the adaptation of adaptive filter 15 may also be carried out in control block 16.

Transfer function C is created for a computation model $G_{nom}$ of a nominal position transducer system 1 to obtain a desired response $\beta_{nom} = C \cdot G_{nom}$ of the open control loop. Computation model $G_{nom}$ of nominal position transducer system 1 is based on nominal parameters, so that computation model $G_{nom}$ maps nominal position transducer system 1. Computation model $G_{nom}$ of nominal position transducer system 1 may take into account only linear components, so the computation model is generally in the following form for n=3:

$$G_{nom}(s) = \frac{1}{a_{nom}s^3 + b_{nom}s^2 + c_{nom}s^1 + d_{nom}}$$

where $a_{nom}$, $b_{nom}$, $c_{nom}$, $d_{nom}$ correspond to model parameters $\Theta_{nom}$ for the nominal position transducer system 1.

In addition, computation model G of position transducer system 1 to be controlled may take only linear components into account, so the computation model is generally in the following form for n=3:

$$G(s) = \frac{1}{as^3 + bs^2 + cs^1 + d}$$

where a, b, c, d correspond to model parameters Θ for position transducer system 1 to be controlled.

Adaptive filter 15 carries out the transfer function $$H = \frac{G_{nom}}{G} = \frac{as^3 + bs^2 + cs^1 + d}{a_{nom}s^3 + b_{nom}s^2 + c_{nom}s^1 + d_{nom}}$$

using system deviation c in such a way that response $\beta = H \sim C \cdot G$ of the open control loop always reverts to desired response $\beta_{nom} = C \cdot G_{nom}$ of the open control loop. Transfer function H of adaptive filter 15 is implemented as a discrete recursive equation with the aid of Tustin's method for discretization. An adapted system deviation $\epsilon_a$ results from this discrete recursive equation.

Control block 16 calculates manipulated variable u as a function of the discrete recursive equation of the implemented transfer function C of the controller and as a function of pilot control variable $u_r$. Control block 16 includes an anti-integration saturation mechanism to calculate its outputs and internal states anew when the absolute value of manipulated variable u exceeds the voltage limits which are a function of additionally measured and modeled state variables z such as battery voltage $U_{bat}$ and the like.

Figure 6:
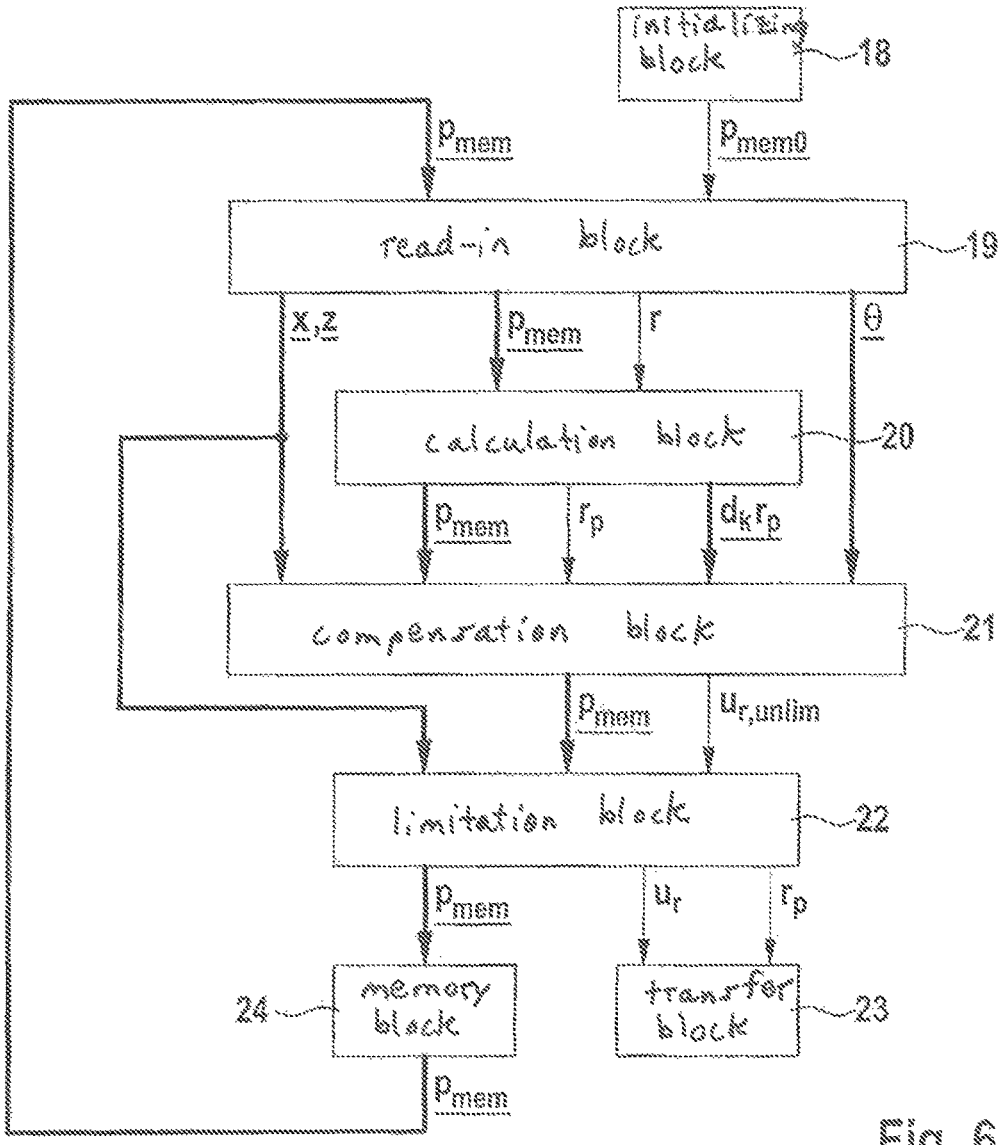
FIG. 6 shows a flow chart to illustrate a method for generating the prefilter signals and the pilot control signals.

FIG. 6 shows a function diagram to illustrate the function carried out in prefilter and pilot control block 7. Prefilter 10 carries out the following transfer function:

$$P(s) = \frac{1}{(1 + \tau_p s)^n}$$

This transfer function may be discretized with the aid of the Tustin transformation. The resulting differential equation yields relationships among the instantaneous values of filtered setpoint position indication $r_p$, its derivations according to vector $d_k r_p$ and their preceding values:

$$\{r_p(k), d_1 r_p(k), \ldots, d_n r_p(k)\} = f(r_p(k-1), d_1 r_p(k-1), \ldots, d_n r_p(k-1))$$

Although the $k-1^{th}$ values are used in Tustin's method proposed above, it is fundamentally possible to use the $k-i^{th}$ values with $i \in \{1 \ldots n\}$.

In FIG. 6, the preceding values of filtered setpoint position indication $r_p$ and its derivations $d_k r_p$ $$\{r_p(k-1), d_1 r_p(k-1), \ldots, d_n r_p(k-1)\}$$

are initialized in an initializing block 18 using predefined initialization values. The initialization values are provided with the aid of a vector of initialization variables $p_{mem0}$. The function of initialization block 18 is called up only once, namely at the start of the control process, to initialize a value vector of preceding values $p_{mem}$. The preceding values $\{r_p(k-1), d_1 r_p(k-1), \ldots, d_n r_p(k-1)\}$ are subsequently copied into value vector $p_{mem}$ after their recalculation.

The variables required by the prefilter and pilot control block 7 for the calculation are input into read-in block 19, in particular the measured and modeled state variables x (of the position transducer system) and z (of the overall system), the value vector $p_{mem}$ for the preceding values of $r_p$ and $d_k r_p$, the setpoint position indication r and the parameter vector of the instantaneously valid parameters $\Theta$.

The differential equation $$\{r_p(k), d_1 r_p(k), \ldots, d_n r_p(k)\} = f(r_p(k-1), d_1 r_p(k-1), \ldots, d_n r_p(k-1))$$

is calculated in calculation block 20 to calculate the filtered setpoint position indication $r_p$ and its derivations $d_k r_p$.

Figure 8:
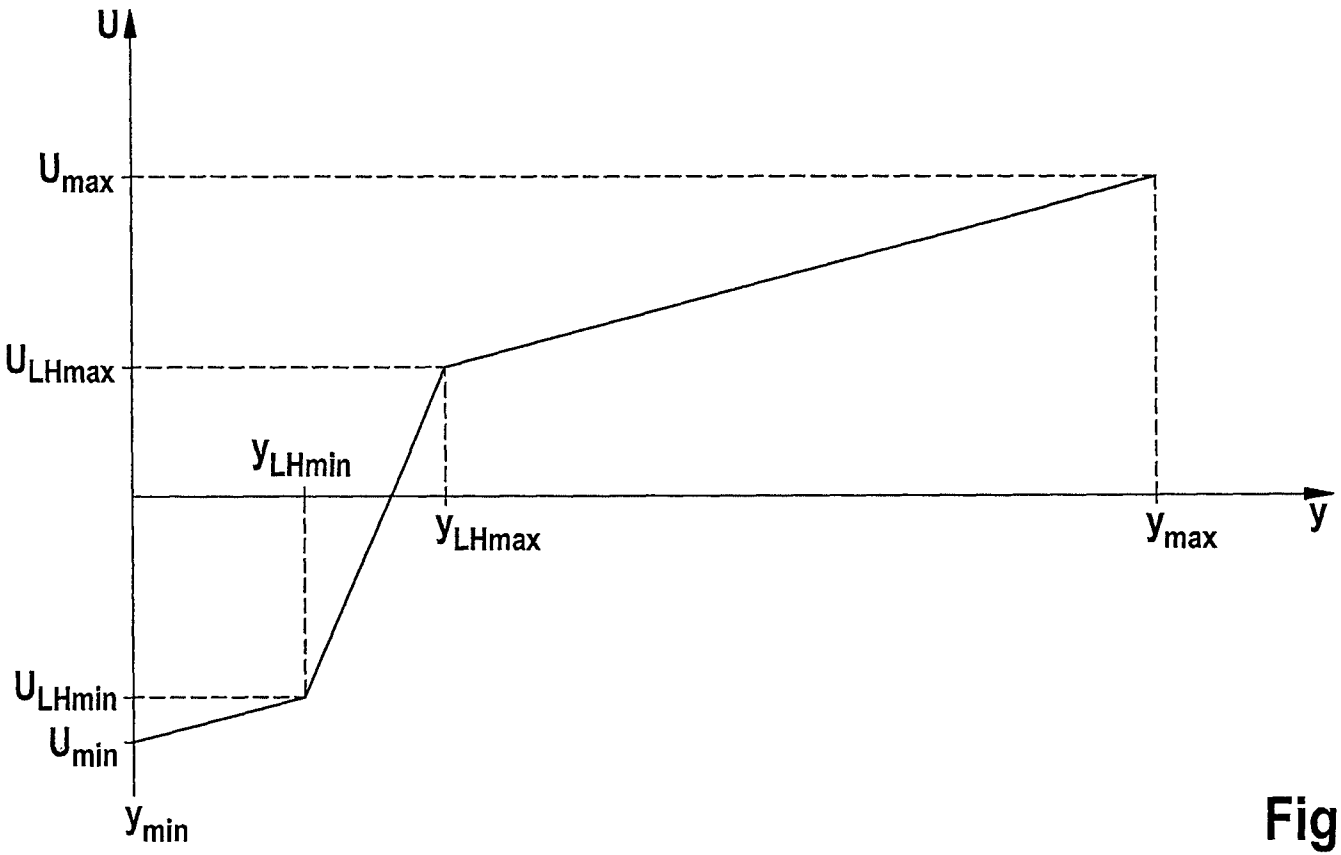
FIG. 8 shows a diagram to illustrate a spring characteristic line for a return spring of a position transducer system of FIG. 1.

In a compensation block 21, compensation of the nonlinearities of position transducer system 1 and the calculation of an unlimited pilot control variable $u_{r_unlim}$ are carried out prior to their limitation to pilot control variable $u_r$. The nonlinearities to be compensated correspond to the emergency operation, for example, and/or the frictional behavior of actuator 2. The compensation of compensation block 21 ensures through a pilot control that nonlinearities do not have a negative effect on the control process. For example, FIG. 8 shows a diagram representing the behavior and position y of actuator 2 at various trigger voltages U. In the diagram in FIG. 8, $U_{max}$ corresponds to the highest possible voltage, $U_{min}$ corresponds to the lowest possible voltage, $y_{max}$ corresponds to the maximum position, $U_{LHmin}$ determines the voltage at a position $y_{LHmin}$ and $U_{LHmax}$ determines the voltage at a position $y_{LHmax}$, the spring characteristic curve having an increased slope between $U_{LHmin}$ and $U_{LHmax}$.

At a trigger voltage of 0 V, which may occur in the event of failure of the trigger system, for example, actuator 2 should assume a position $y_0$ which allows a certain gas mass flow rate through position transducer system 1 to ensure the emergency operation. In the area around position $y_0$ of actuator 2, a return spring acts on actuator 2 with an increased spring constant. The increased spring constant in particular acts on actuator 2 in a range $y_{LHmin} < y_0 < y_{LHmax}$ whereas a lower spring constant acts on actuator 2 in the outside areas.

Unlimited pilot control variable $U_{r_unlim}$ is compared with battery voltage $U_{bat}$ in limitation block 22. If the absolute value of battery voltage $U_{bat}$ is not exceeded, then pilot control variable $u_r$ is set to the value of unlimited pilot control variable $u_{r_unlim}$. If the absolute value of battery voltage $U_{bat}$ is exceeded, unlimited pilot control variable $u_{r_unlim}$ is limited to the value of battery voltage $U_{bat}$ and filtered setpoint position indication $r_p$ and its derivations $d_k r_p$ $\{r_p(k-1), d_1 r_p(k-1), \ldots, d_n r_p(k-1)\}$ are calculated anew, taking into account the fact that pilot control variable $u_r$ is limited to the value of battery voltage $U_{bat}$.

Pilot control variable $u_r$ and filtered setpoint position indication $r_p$ are transferred to control block 8 in a transfer block 23.

The instantaneous values of vector $p_{mem}$ are stored in a memory block 24 to be available for the next calculation by prefilter and pilot control block 7.

Figure 7:
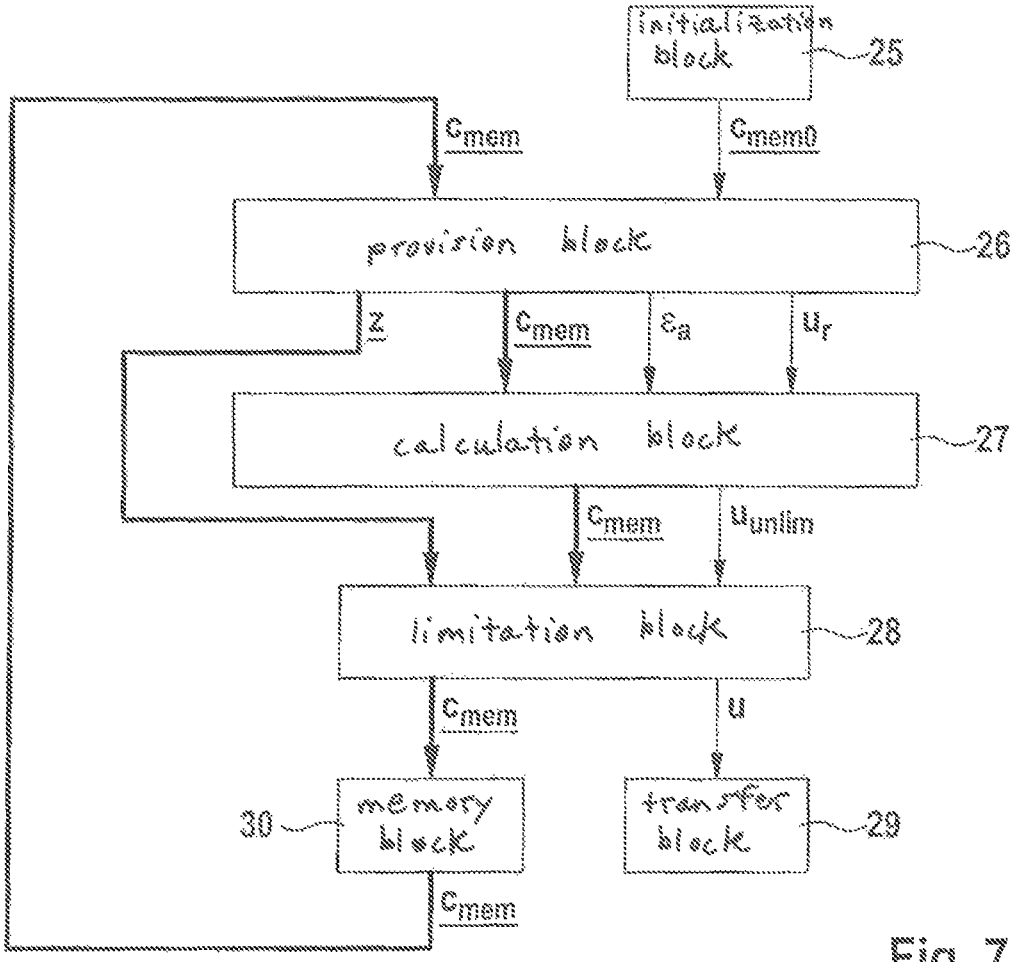
FIG. 7 shows a flow chart to illustrate a method for generating the manipulated variable for controlling a position transducer system via a throttle valve position transducer according to FIG. 1.

FIG. 7 shows a flow chart to illustrate a method for generating manipulated variable u in control block 16. Control block 16 carries out a calculation according to a predefined transfer function C, which may correspond to that of a PIDT1 control, for example. In this case, the carried out transfer function corresponds to:

$$C(s) = K_p + \frac{K_i}{s} + \frac{K_d s}{1 + \tau_d s}$$

including constant control parameters $K_p$, $K_i$, $K_d$ for the proportional component, the integration component, the differential component of the control and time constant $\tau_d$. The control parameters remain unchanged even during adaptation of the control process and constitute the optimal control parameters, i.e., those ascertained previously with respect to a reference position transducer system.

This transfer function C may be discretized with the aid of Tustin's transformation. Tustin's discretization method has the advantage that the resulting differential equation includes only simple computation operations, which may be executed in real time even on a low-power control unit. The resulting differential equations define a relationship between the instantaneous values of adapted system deviation $\epsilon_a$ and their preceding values. In addition, manipulated variable u corresponds to a function of the results of the differential equations and of pilot control variable $u_r$:

$$u(k) = g_1(u_r(k), \epsilon_u(k), \epsilon_a(k-1))$$

In FIG. 7, the preceding value of adapted system deviation $\epsilon_a$, $\epsilon_a(k-1)$ is initialized in initialization block 25 using the predefined initialization value. The initialization value is provided with the aid of a value vector of initialization variables $c_{mem0}$. The function of initialization block 25 is called up only once, namely at the start of the control process, to initialize a value vector of preceding values $c_{mem}$. Preceding value $\epsilon_a(k-1)$ is subsequently copied into value vector $c_{mem}$ after its recalculation.

In a provision block 26, the variables required for the calculation in control block 16 are input, i.e., measured and modeled state variables z, value vector $c_{mem}$ of the preceding values, adaptive system deviation $\epsilon_a$ and pilot control variable $u_r$.

The differential equation $$u_{unlim}(k) = g_2(u_r(k), \epsilon_a(k), \epsilon_a(k-1))$$

is calculated in a calculation block 27 to ascertain unlimited manipulated variable $u_{unlim}$.

In limitation block 28, the anti-integration saturation function is taken into account to carry out a new calculation when unlimited manipulated variable $u_{unlim}$ reaches a predefined voltage limit. The predefined voltage limit may be calculated according to a predefined function of the additionally measured and modeled state variables z such as battery voltage $U_{bat}$ and the like, for example. A traditional anti-integration saturation function involves freezing the integration part of the control, so that the integration part does not diverge. Unlimited manipulated variable $u_{unlim}$ may also be compared to battery voltage $U_{bat}$. If battery voltage $U_{bat}$ is not exceeded, manipulated variable u is set at the value of unlimited manipulated variable $u_{unlim}$. If battery voltage $U_{bat}$ is exceeded, manipulated variable u is limited to the value of battery voltage $U_{bat}$ and the integration part of the control is frozen.

In a transfer block 29, manipulated variable u is transferred to actuating drive 6 of position transducer system 1. As described above, the manipulated variable may correspond to a pulse duty factor T.

In a memory block 30, the instantaneous values of value vectors $c_{mem}$ are stored for the next calculation by control block 16.

What is claimed is:

1. A method for operating a controller for a position transducer system, which is a throttle valve position transducer in an engine system having an internal combustion engine, the method comprising:

applying a first transfer function to a system deviation to obtain an adapted system deviation, the first transfer function being a function which indicates a deviation of a model of a nominal position transducer system having predefined nominal parameters from the model of the position transducer system to be controlled;

applying a second transfer function that corresponds to a controller, and that is different than the first transfer function, to the adapted system deviation to obtain a manipulated variable, wherein the controller includes at least a proportional control parameter, an integration control parameter, a differential control parameter, and a time constant;

triggering an actuating drive of the position transducer system based on the manipulated variable; and adapting a control process for controlling the position transducer system by adapting the first transfer function, wherein adapting the first transfer function includes adapting, in real time, the parameters of the model of the position transducer system to be controlled.

2. The method of claim 1, wherein the second transfer function represents a control function having constant predefined control parameters, which are ascertained with respect to a nominal position transducer system and are invariant for adaptation of the control process.

3. The method of claim 1, wherein only linear components are taken into account as the model of the nominal position transducer system and as the model of the position transducer system to be controlled.

4. The method of claim 1, wherein the second transfer function additionally takes into account a pilot control variable, which is ascertained as a function of an inverse model of the position transducer system to be controlled, in real time.

5. The method of claim 4, wherein a nonlinear component of the model of the position transducer system to be controlled is taken into account in the pilot control to compensate for nonlinearities in the position transducer system.

6. The method of claim 1, wherein the second transfer function is implemented as a discrete recursive equation with Tustin's method.

7. The method of claim 1, wherein the proportional control parameter, the integration control parameter, the differential control parameter, and the time constant remain unchanged during adaptation of the control process.

8. The method of claim 1, wherein the controller is a PIDT1 controller.

9. A control system for operating a controller for a position transducer system, comprising:

an adaptive filter configured to apply a first transfer function to a system deviation in order to obtain an adapted system deviation, the first transfer function representing a function which indicates a deviation of a provided model of a nominal position transducer system having predefined nominal parameters, from a provided model of the position transducer system to be controlled; and a control block configured to:

apply a second transfer function that corresponds to a controller, and that is different than the first transfer function, to the adapted system deviation to obtain a manipulated variable, wherein the controller includes at least a proportional control parameter, an integration control parameter, a differential control parameter, and a time constant; and trigger an actuating drive of the position transducer system;

wherein the adaptive filter is configured to adapt the model of the position transducer system to be controlled in accordance with providable model parameters, in real time.

10. The control system of claim 9, wherein the proportional control parameter, the integration control parameter, the differential control parameter, and the time constant remain unchanged during adaptation of the control process.

11. The control system of claim 9, wherein the controller is a PIDT1 controller.

12. A computer readable medium having a computer program, which is executable by a processor, comprising:

a program code arrangement having program code for operating a controller for a position transducer system, which is a throttle valve position transducer in an engine system having an internal combustion engine, by performing the following:

applying a first transfer function to a system deviation to obtain an adapted system deviation, the first transfer function being a function which indicates a deviation of a model of a nominal position transducer system having predefined nominal parameters from the model of the position transducer system to be controlled;

applying a second transfer function that corresponds to a controller, and that is different than the first transfer function, to the adapted system deviation to obtain a manipulated variable, wherein the controller includes at least a proportional control parameter, an integration control parameter, a differential control parameter, and a time constant;

triggering an actuating drive of the position transducer system based on the manipulated variable; and adapting a control process for controlling the position transducer system by adapting the first transfer function, wherein adapting the first transfer function includes adapting, in real time, the parameters of the model of the position transducer system to be controlled.

13. The computer readable medium of claim 12, wherein the second transfer function represents a control function having constant predefined control parameters, which are ascertained with respect to a nominal position transducer system and are invariant for adaptation of the control process.

14. The computer readable medium of claim 12, wherein only linear components are taken into account as the model of the nominal position transducer system and as the model of the position transducer system to be controlled.

15. The computer readable medium of claim 12, wherein the second transfer function additionally takes into account a pilot control variable, which is ascertained as a function of an inverse model of the position transducer system to be controlled, in real time.

16. The computer readable medium of claim 15, wherein a nonlinear component of the model of the position transducer system to be controlled is taken into account in the pilot control to compensate for nonlinearities in the position transducer system.

17. The computer readable medium of claim 12, wherein the second transfer function is implemented as a discrete recursive equation with Tustin's method.

18. The control system of claim 12, wherein the proportional control parameter, the integration control parameter, the differential control parameter, and the time constant remain unchanged during adaptation of the control process.

19. The control system of claim 12, wherein the controller is a PIDT1 controller.

* * * * *